US006812910B2

(12) United States Patent
Chou

(10) Patent No.: US 6,812,910 B2
(45) Date of Patent: Nov. 2, 2004

(54) DRIVING METHOD FOR LIQUID CRYSTAL DISPLAY

(75) Inventor: Hsien-Ying Chou, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 0 days.

(21) Appl. No.: 10/701,278

(22) Filed: Nov. 3, 2003

(65) Prior Publication Data

US 2004/0090394 A1 May 13, 2004

(30) Foreign Application Priority Data

Nov. 4, 2002 (TW) ..... 91132495 A

(51) Int. Cl.[7] ..... G09G 3/36

(52) U.S. Cl. ..... 345/90; 345/93

(58) Field of Search ..... 345/90, 93, 94; 315/169.3, 169.4

(56) References Cited

U.S. PATENT DOCUMENTS 5,526,012 A * 6/1996 Shibahara ..... 345/92
6,476,786 B1 * 11/2002 Miyachi ..... 345/90

* cited by examiner

*Primary Examiner*—David Vu
(74) *Attorney, Agent, or Firm*—Fish & Richardson P.C.

(57) ABSTRACT

A driving method for a liquid crystal display having a plurality of pixels. Each pixel has a liquid crystal unit and a transistor. First, a gate voltage of the transistor is changed to drive the transistor. Then, a first display voltage of a first frame is applied to the liquid crystal unit. Next, the display voltage of the liquid crystal unit is changed to a blanking display voltage of a black frame by changing the gate voltage of the transistor. At this time, the black frame is displayed on the liquid crystal unit. Thus, the long response time of the liquid crystal display is improved. Finally, the gate voltage of the transistor is changed again and a second display voltage of a second frame is applied to the liquid crystal unit.

3 Claims, 2 Drawing Sheets

DRIVING METHOD FOR LIQUID CRYSTAL DISPLAY

BACKGROUND OF THE INVENTION

1. Field of the Invention

The present invention relates to a driving method for a liquid crystal display and particularly to a driving method using variation in gate voltages to improve response time in the liquid crystal display.

2. Description of the Prior Art

Blinking backlights to improve response time in liquid crystal displays require particular lamps and driving circuits. The development and design of these systems and elements are thus complex and costly.

A driving method applying multiple data inputs to one liquid crystal unit during one display period decreases the response time of the liquid crystal display, however, a data driver and a scan driver of an original liquid crystal display must be modified for application in this type of system, as must original data applied to the liquid crystal unit, all of which contributes to higher development and design costs.

SUMMARY OF THE INVENTION

The object of the present invention is to provide a driving method for a liquid crystal display. The response time of the liquid crystal display is decreased by changing the gate voltage to add a black frame between two data inputs. Thus, only a scan driver of the liquid crystal display must be modified. The development and design costs of these systems are thus decreased.

The present invention provides a driving method for a liquid crystal display having a plurality of pixels. Each pixel has a liquid crystal unit and a transistor. A drain and a gate of the transistor are connected to a data line and a scan line, respectively. A source of the transistor is connected to a first electrode of the liquid crystal unit. A second electrode of the liquid crystal unit is connected to a common electrode. First, a gate voltage of the transistor is changed to drive the transistor. Then, a first display voltage of a first frame is applied to the liquid crystal unit. Next, the display voltage of the liquid crystal unit is changed to a blanking display voltage of a black frame by changing the gate voltage of the transistor. At this time, the black frame is displayed on the liquid crystal unit. Thus, the long response time of the liquid crystal display is improved. Finally, the gate voltage of the transistor is changed again and a second display voltage of a second frame is applied to the liquid crystal unit.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 1:
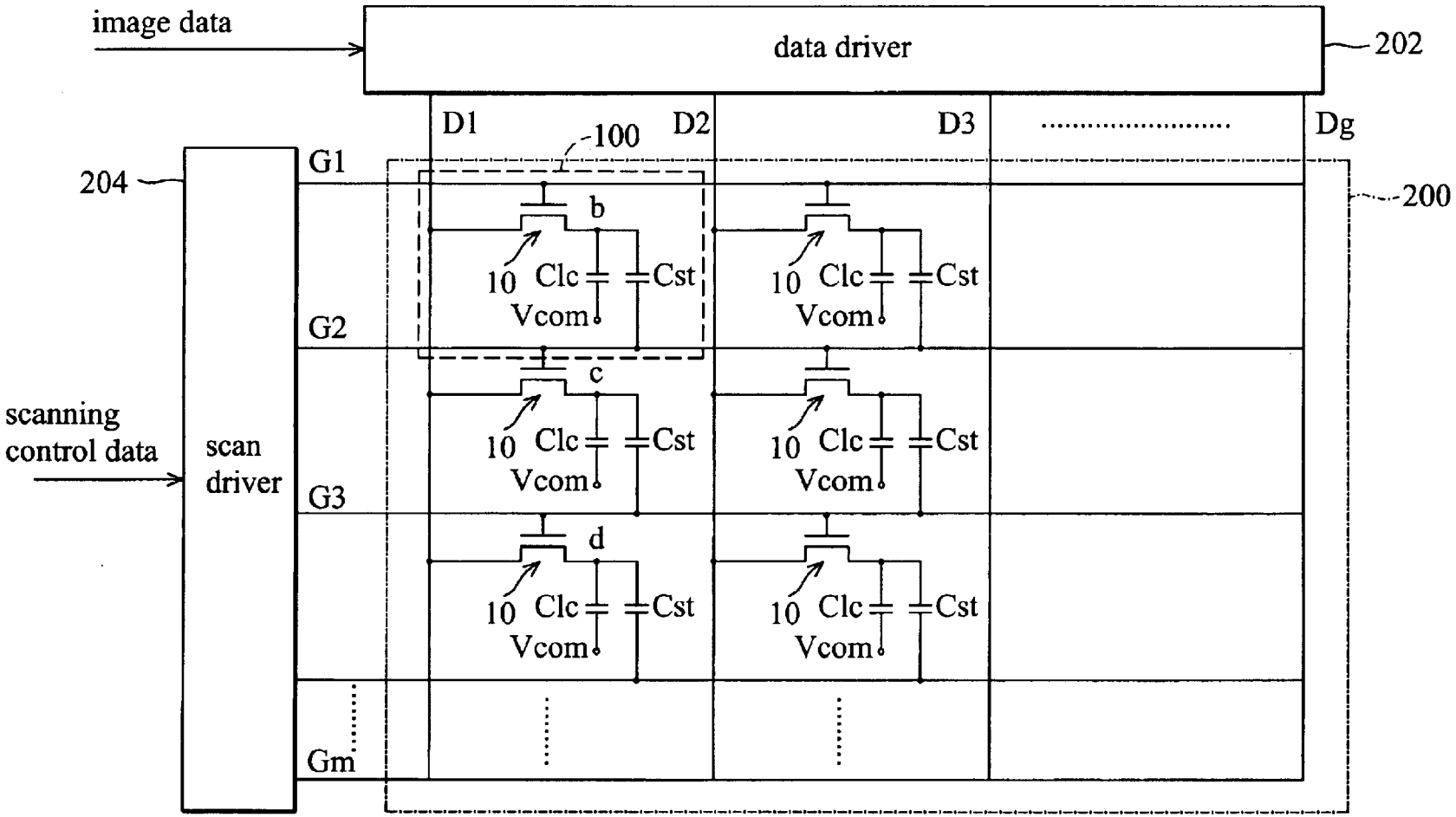
FIG. 1 is a schematic structural diagram of an LCD panel according to an embodiment of the present invention.
Figure 2:
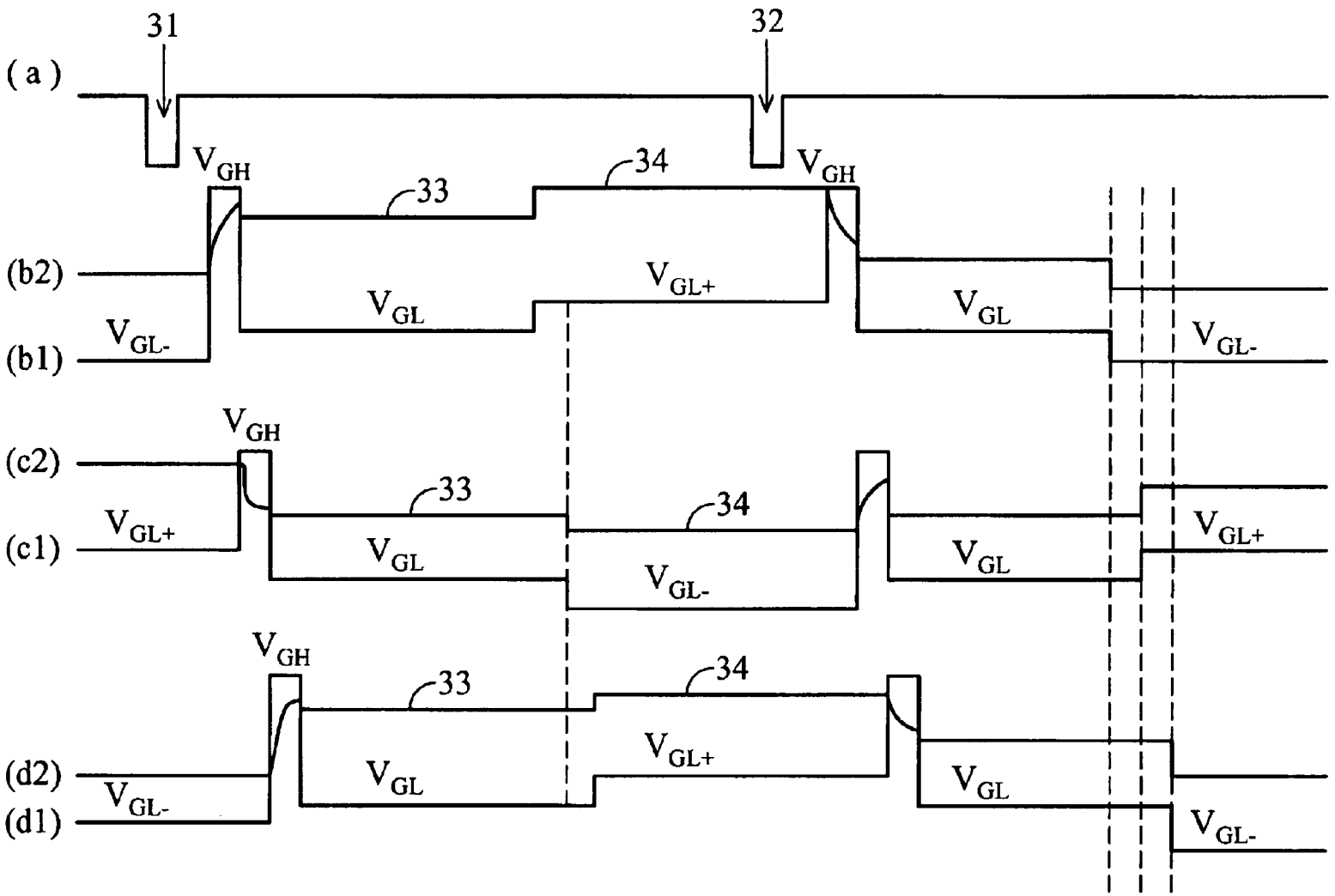
FIG. 2 is a diagram of the voltage waveforms changed on the drive clock, three continuous scan lines and the voltage waveform across liquid crystals during two continuous frames according to the embodiment of the present invention.

FIG. 1 is a schematic structural diagram of an LCD panel according to the embodiment of the present invention. As shown in FIG. 2, an LCD panel 200 has a plurality of pixels 100 arranged in an array structure. Each pixel 100 includes a liquid crystal capacitor $C_{lc}$ of LC molecules, a control transistor 10 and a storage capacitor $C_S$. The drain terminal and the gate terminal of the control transistor 10 are connected to data lines (denoted by D1, D2 . . . ) and scan lines (denoted by G1, G2 . . . ), respectively. The source terminal of the control transistor 10 is connected to a first electrode on one side of the liquid crystal capacitor $C_{lc}$. A second electrode on the other side of the LC capacitor $C_{lc}$ is connected to a common electrode Vcom. Furthermore, the data lines and the scan lines are coupled to a data driver 202 and a scan driver 204, respectively. These data lines and scan lines control the pixels according to image data and scanning control data.

In the present embodiment, the LCD panel 200 driven by two-level gate voltages is used as an example. The method provided by the present invention can be used in other LCD panels driven by multi-level gate voltages.

According to the present method, the scan driver 204 changes the gate voltage of the transistor 10 to drive the transistor 10. Then, a first display voltage of a first frame is applied to the liquid crystal capacitor $C_{lc}$.

The varying amount of the gate voltage can be coupled to the liquid crystal capacitor $C_{lc}$ to change the display voltage. Thus, the display voltage of the liquid crystal capacitor $C_{lc}$ is changed to a blanking display voltage of a black frame by changing the gate voltage of the transistor 10. At this time, the black frame is displayed on the liquid crystal unit. Finally, the scan driver 204 changes the gate voltage of the transistor 10 to drive the transistor 10 again and a second display voltage of a second frame is applied to the liquid crystal capacitor $C_{lc}$.

FIG. 2 is a diagram of the voltage waveforms changed on the drive clock, three scan lines and the voltage waveform across liquid crystals during two continuous frames according to the embodiment of the present invention. In the present embodiment, line inversion is used as an example. Signal line (a) is the drive clock of the LCD panel 200. Between two vertical synchronizing signals 31 and 32, the voltage waveforms changed on three scan lines and the voltage waveforms across liquid crystals during two continuous frames of the embodiment in the present invention are shown in FIG. 2. To simply the illustration, scan lines G1, G2, and G3 shown in FIG. 1 are used as an example. Signal lines (b1), (c1) and (d1) represent the voltage waveform changed on scan lines G1, G2 and G3 respectively. The voltage changed on each scan line is equal to the voltage change on the gate of the transistor 10. Signal lines (b2), (c1) and (d2) represent the voltage waveform changed on the liquid crystal capacitors $C_{lc}$ between scan lines G1 and G2, G2 and G3, G3 and G4 respectively corresponding to points b, c, d shown in FIG. 1.

In FIG. 2, voltage $V_{GH}$ represents the voltage when the transistor 10 turns on and voltage $V_{GL}$ the voltage when the transistor 10 turns off.

After the vertical synchronizing signal 31, the gate voltage of the transistor 10 coupled to the scan line G1 is changed. After the gate voltage moves to the voltage $V_{GH}$ (referring to the signal line b1), the transistor 10 coupled to the scan line G1 is driven. A first display voltage of a first frame is applied to the liquid crystal capacitor $C_{lc}$. Thus, the voltage of point b can be changed (referring to the signal line b2). When the transistor 10 coupled to the scan line G1 turns off and the gate voltage moves to the voltage $V_{GL}$, the voltage of the liquid crystal capacitor $C_{lc}$ equals the first display voltage (referring 33 shown in FIG. 2).

Then, the gate voltage of the transistor 10 coupled to the scan line G1 is changed to a voltage $V_{GL+}$. Thus, the display voltage of the liquid crystal capacitor $C_{lc}$ is coupled to a blanking display voltage of a black frame (referring 34 shown in FIG. 2). At this time, the black frame is displayed on the liquid crystal unit.

After the vertical synchronizing signal 32, the gate voltage of the transistor 10 coupled to the scan line G1 is changed again. After the gate voltage moves to the voltage $V_{GH}$ (referring to the signal line b1), the transistor 10 coupled to the scan line G1 is driven. A second display voltage of a second frame is applied to the liquid crystal capacitor $C_{lc}$.

After the vertical synchronizing signal 31 and the gate voltage of the transistor 10 coupled to the scan line G1 moves from the voltage $V_{GH}$ to the voltage $V_{GL}$, the gate voltage of the transistor 10 coupled to the scan line G2 is changed. After the gate voltage moves to the voltage $V_{GH}$ (referring to the signal line c1), the transistor 10 coupled to the scan line G2 is driven. A first display voltage of a first frame is applied to the liquid crystal capacitor $C_{lc}$. Thus, the voltage of point c can be changed (referring to the signal line c2). When the transistor 10 coupled to the scan line G2 turns off and the gate voltage moves to the voltage $V_{GL}$, the voltage of the liquid crystal capacitor $C_{lc}$ equals the first display voltage (referring 33 shown in FIG. 2).

Then, the gate voltage of the transistor 10 coupled to the scan line G2 is changed to a voltage $V_{GL-}$. Thus, the display voltage of the liquid crystal capacitor $C_{lc}$ is coupled to a blanking display voltage of a black frame (referring 34 shown in FIG. 2). At this time, the black frame is displayed on the liquid crystal unit.

After the vertical synchronizing signal 32 occurs and the gate voltage of the transistor 10 coupled to the scan line G1 moves from the voltage $V_{GH}$ to the voltage $V_{GL}$, the gate voltage of the transistor 10 coupled to the scan line G2 is changed again. After the gate voltage moves to the voltage $V_{GH}$ (referring to the signal line c1), the transistor 10 coupled to the scan line G2 is driven. A second display voltage of a second frame is applied to the liquid crystal capacitor $C_{lc}$.

After the vertical synchronizing signal 31 occurs and the gate voltage of the transistor 10 coupled to the scan line G2 moves from the voltage $V_{GH}$ to the voltage $V_{GL}$, the gate voltage of the transistor 10 coupled to the scan line G3 is changed. After the gate voltage moves to the voltage $V_{GH}$ (referring to the signal line d1), the transistor 10 coupled to the scan line G3 is driven. A first display voltage of a first frame is applied to the liquid crystal capacitor $C_{lc}$. Thus, the voltage of point c can be changed (referring to the signal line d2). When the transistor 10 coupled to the scan line G3 turns off and the gate voltage moves to the voltage $V_{GL}$, the voltage of the liquid crystal capacitor $C_{lc}$ equals the first display voltage (referring 33 shown in FIG. 2).

Then, the gate voltage of the transistor 10 coupled to the scan line G3 is changed to a voltage $V_{GL+}$. Thus, the display voltage of the liquid crystal capacitor $C_{lc}$ is coupled to a blanking display voltage of a black frame (referring 34 shown in FIG. 2). At this time, the black frame is displayed on the liquid crystal unit.

After the vertical synchronizing signal 32 occurs and the gate voltage of the transistor 10 coupled to the scan line G2 moves from the voltage $V_{GH}$ to the voltage $V_{GL}$, the gate voltage of the transistor 10 coupled to the scan line G3 is changed again. After the gate voltage moves to the voltage $V_{GH}$ (referring to the signal line d1), the transistor 10 coupled to the scan line G3 is driven. A second display voltage of a second frame is applied to the liquid crystal capacitor $C_{lc}$.

In the present embodiment, line inversion is used as an example to illustrate the voltage waveforms changed on three scan lines G1~G3 and the voltage waveforms across liquid crystals during two continuous frames of the LCD panel 200. Continuously, three scan lines of the LCD panel 200 such as Gn−1, Gn and Gn+1 (any continuously three scan lines of G1~Gm) can be analogized in the above illustration. Furthermore, other drive methods such as dual-lines inversion and multi-lines inversion can also be used in the present invention.

Using the present driving method for the liquid crystal display, the response time of the liquid crystal display is decreased by changing the gate voltage to add a black frame between two data read in. Thus, only a scan driver of the liquid crystal display must be modified. The development and design costs of these kind system are thus decreased.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A driving method for a liquid crystal display having a plurality of pixels, each pixel having a liquid crystal unit and a transistor, with a drain and a gate of the transistor connected to a data line and a scan line, respectively, a source of the transistor connected to a first electrode of the liquid crystal unit, a second electrode of the liquid crystal unit connected to a common electrode, the method comprising:

driving the transistor by changing a gate voltage of the transistor;

applying a first display voltage of a first frame to the liquid crystal unit; and changing the display voltage of the liquid crystal unit to a blanking display voltage of a black frame by changing the gate voltage of the transistor.

2. The driving method as claimed in claim 1, further comprising the following steps:

driving the transistor by changing the gate voltage of the transistor; and applying a second display voltage of a second frame to the liquid crystal unit.

3. A driving method for a liquid crystal display having a plurality of pixels, each pixel having a liquid crystal unit and a transistor, with a drain and a gate of the transistor connected to a data line and a scan line, respectively, a source of the transistor connected to a first electrode of the liquid crystal unit, a second electrode of the liquid crystal unit connected to a common electrode, the method comprising:

changing a gate voltage of the transistor to drive the transistor;

during a display period of a frame, for each pixel, applying a display voltage to a liquid crystal unit and changing the display voltage of the liquid crystal unit to a blanking display voltage of a black frame by changing the gate voltage of the transistor.

* * * * *